United States Patent [19]

Rudish et al.

[11] Patent Number: 4,980,692

[45] Date of Patent: Dec. 25, 1990

[54] FREQUENCY INDEPENDENT CIRCULAR ARRAY

[75] Inventors: Ronald M. Rudish, Commack; Peter J. McVeigh, Hauppauge, both of N.Y.

[73] Assignee: AIL Systems, Inc., Deer Park, N.Y.

[21] Appl. No.: 443,464

[22] Filed: Nov. 29, 1989

[51] Int. Cl.[5] ..... H01Q 1/38

[52] U.S. Cl. ..... 343/700 MS; 343/708; 343/778

[58] Field of Search ..... 343/700 MS, 708, 873, 343/778, 853, 893

[56] References Cited

U.S. PATENT DOCUMENTS

| | | | |
|---|---|---|---|
| 3,018,479 | 1/1962 | Kelly | 343/708 |
| 3,110,030 | 11/1963 | Cole, Jr. | 343/873 |
| 3,530,478 | 9/1970 | Corzine et al. | 343/708 |
| 3,653,057 | 3/1972 | Charlton | 343/853 |
| 3,736,592 | 5/1973 | Coleman | 343/777 |
| 3,789,417 | 1/1974 | Coleman | 343/753 |
| 3,803,618 | 4/1974 | Coleman | 343/853 |
| 3,964,066 | 6/1976 | Nemit . | |
| 4,101,895 | 7/1978 | Jones, Jr. | 343/708 |
| 4,162,499 | 7/1979 | Jones, Jr. et al. | 343/700 MS |
| 4,316,192 | 2/1982 | Acoraci | 343/853 |
| 4,414,550 | 11/1983 | Tresselt | 343/700 MS |

OTHER PUBLICATIONS

*Microstrip Antenna Array With Multi-Octave Bandwidth*, Microwave Journal, Mar. 1986, by Peter S. Hall.

*Primary Examiner*—Rolf Hille
*Assistant Examiner*—Hoanganh Le
*Attorney, Agent, or Firm*—Hoffmann & Baron

[57] ABSTRACT

A circular array includes a plurality of antenna elements which are spaced apart from each other and situated in a conical arrangement and in parallel rows circumferentially about the longitudinal axis of the conical arrangement. The circumferential spacing between the phase centers of adjacent antenna elements of any one row situated closer to the base of the conical arrangement is greater than that of adjacent antenna elements situated relatively closer to the apex of the conical arrangement. The respective operating frequencies of the antenna elements of any one row situated closer to the base of the conical arrangment is lower than the operating frequencies of the antenna elements of any other row situated relatively closer to the apex. The circuit array antenna further includes a plurality of feed lines, where each feed line is coupled to an antenna element of each row in progression. The circumferential spacing between the phase centers of adjacent antenna elements of the conical arrangement is maintained at a fixed value of the wavelength of the operating frequencies of the antenna elements.

7 Claims, 3 Drawing Sheets

FREQUENCY INDEPENDENT CIRCULAR ARRAY

BACKGROUND OF THE INVENTION

1. Field of the Invention

This invention relates to antennas, and more particularly relates to frequency independent circular antenna arrays.

2. Description of the Prior Art

Electronically steerable circular array antenna systems are well known in the art and are described in numerous patents, such as, for example, U.S. Pat. No. 4,414,550 to Carl P. Tresselt and U.S. Pat. No. 4,316,192 to Joseph H. Acoraci. Such circular arrays have N number of antenna elements, and are usually coupled to an $N \times N$ Butler matrix, N or $N-1$ phase shifters and a signal combining network. As is well known, the Butler matrix is an orthogonal beam network that provides a discrete Fourier transform of the signals received by the antenna elements. The transformed signals have amplitudes which are substantially independent of the direction of wavefront incidence and phase values which are approximately linearly dependent on direction of wavefront incidence. In these respects, the transformed signals resemble those produced by a linear array, so it is said in the art that the Butler matrix "linearizes" the circular array. Indeed, the plurality of phase shifters which are used to steer the antenna beam pattern and the signal combining network which is used to form the beam pattern of the circular array are interconnected and controlled in a manner similar to that for a linear array.

One of the problems with Butler matrix fed circular arrays producing electronically steerable directional beams is that they tend to have limited bandwidths. It has been discovered that for frequencies where the spacing between the antenna elements of the array is in excess of about 0.5 wavelengths, beam distortion and scanning irregularities increase rapidly with an increase in spacing. The reason is that the approximation used to linearize the circular array is accurate only when the spacing between antenna elements is small, and the spacing must generally be less than about one-half wavelength for the approximation to hold true.

Accordingly, one would like to keep the spacing between antenna elements low. However, it has been discovered that for spacings less than 0.3 wavelengths, mutual coupling between antenna elements causes impedance mismatch which increases with a decrease in spacing.

OBJECTS AND SUMMARY OF THE INVENTION

It is an object of the present invention to provide a circular array antenna system which in principle is frequency independent and in practice can be implemented for very wide bandwidth.

It is another object of the present invention to provide a Butler matrix fed circular array producing an electronically steerable directional beam, which array minimizes beam distortion at relatively high frequency operation.

It is a further object of the present invention to provide a circular array antenna which minimizes the mutual coupling between antenna elements which may cause impedance mismatch when the array is operated at relatively low frequencies.

It is still another object of the present invention to provide a circular array antenna which overcomes the disadvantages of known circular array antennas.

In accordance with one form of the present invention, a circular array antenna includes a plurality of antenna elements, that is, either radiating or receiving elements or both. The antenna elements are spaced apart from each other and situated in a conical arrangement and in parallel rows circumferentially about the longitudinal axis of the conical arrangement.

Each antenna element has a phase center. The circumferential spacing between the phase centers of adjacent antenna elements of any one row situated relatively closer to the base or wider portion of the conical arrangement is greater than that of adjacent antenna elements situated relatively closer to the apex or narrower portion of the conical arrangement. Also, the respective operating frequencies of the antenna elements of any one row situated relatively closer to the base of the conical arrangement is lower than the operating frequencies of the antenna elements of any other row situated relatively closer to the apex of the conical arrangement.

The circular array antenna further includes a plurality of feed lines which may extend substantially in the general direction of the longitudinal axis of the conical arrangement, that is, from the base to the apex. One antenna element of each row is coupled to a respective feed line.

With the arrangement described above, the circumferential spacing between the phase centers of adjacent antenna elements of the conical arrangement of elements is maintained at a fixed value or range of values of the corresponding wavelength of the operating frequency of the antenna elements. This spacing is preferably between about $0.3\lambda$ and about $0.4\lambda$, where $\lambda$ is the wavelength of the operating frequency of the antenna elements.

At higher frequencies, antenna elements situated closer to the apex of the conical arrangement will resonate, i.e., operate. At lower frequencies, the antenna elements situated closer to the base of the conical arrangement will resonate. Accordingly, with the antenna elements arranged as described above, the spacing in wavelengths between the phase centers of the antenna elements for all frequencies will remain constant at an optimally chosen design value such as between $0.3\lambda$ and $0.4\lambda$, so that beam distortion and excessive mutual coupling (which can cause impedance mismatch) will be substantially avoided.

These and other objects, features and advantages of this invention will be apparent from the following detailed description of illustrative embodiments thereof, which is to be read in connection with the accompanying drawings

DETAILED DESCRIPTION OF THE PREFERRED EMBODIMENTS

Figure 1:
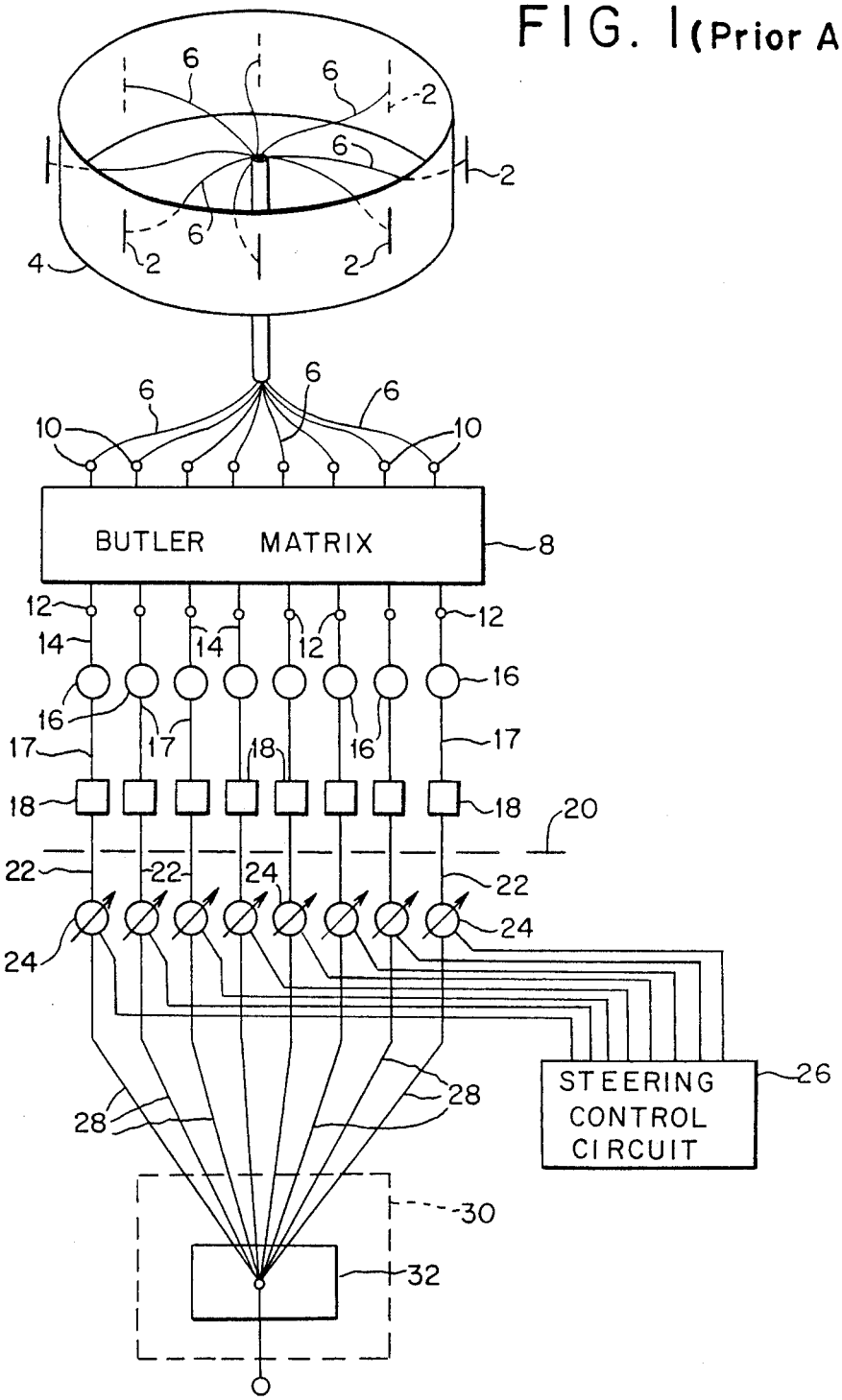
FIG. 1 (Prior Art)
FIG. 1 is a block diagram of a conventional circular antenna array and the feed networks for the array.

Referring initially to FIG. 1 of the drawings, a conventional circular antenna array and the feed networks for the array are illustrated. A more common name for the type of antenna arrangement shown in FIG. 1 is a Butler matrix fed cylindrical array. If all components used in the arrangement are reciprocal, the arrangement has the same properties for both transmit and receive. For convenience in describing the conventional array illustrated by FIG. 1 and the invention, the following discussion will generally describe the arrangement in the receive mode.

The conventional circular antenna array basically is an array of N discrete antenna elements 2 having circular symmetry. For example, the array may be comprised of a plurality of dipoles equally spaced and arranged in a circle, concentric with a conducting cylinder 4. Each dipole antenna element 2 is connected by a coaxial cable 6 or like transmission line, all of which are equal in length, to a feed network, which may include a Butler matrix 8. The Butler matrix 8 is, in effect, a real time analog discrete Fourier transformer, and is used to linearize the circular array. The operation of the Butler matrix will be described in greater detail.

The Butler matrix 8 has N input ports 10 (when viewed in the receive mode) which are connected to the antenna elements 2, and usually N output ports 12. The output ports 12 of the Butler matrix are connected by N equal length transmission lines 14 to a plurality of phase shifters 16. The phase shifters 16 are provided for equalizing the phase shift and delay of each of the output signals provided by the Butler matrix 8. The outputs of the phase shifters 16, in turn, are connected by N equal length transmission lines 17 to a plurality of amplitude weighting devices 18, such as attenuating pads or amplifiers, which are used to equalize the amplitudes (or weight the amplitudes for sidelobe suppression) of the signals from the Butler matrix 8.

At the interface illustrated by the dashed line 20 in FIG. 1, that is, after the signals have passed through the Butler matrix 8, phase shifters 16 and amplitude weighting devices 18, the circular array appears to act like a linear array.

The outputs of the amplitude weighting devices 18 are connected by N equal length transmission lines 22 to a plurality of variable phase shifters 24. The variable phase shifters 24 form part of a beam steering network. The phase shifters 24 are connected to and controlled by a steering circuit 26, which commands each phase shifter 24 to provide a predetermined amount of phase shift to the signal passing through the phase shifter.

The antenna patterns are steered electronically by applying a linear phase gradient at the output ports of the Butler matrix 8, the linear phase gradient being accomplished through the use of the phase shifters 24. Proper adjustment of the various phase shifters 24 will cause the antenna patterns to steer to a spatial angle that is the same as the electrical phase gradient angle across the various phase shifters. In some circular array antennas, not all of the Butler matrix output ports are connected to phase shifters. For example, in the antenna described in U.S. Pat. No. 4,316,192, all except one of the Butler matrix output ports are connected to the phase shifters; the unused port of the Butler matrix may be terminated by a characteristic impedance to absorb any out of balance signals, as is well known to those skilled in the art. The usual reason for not using all the Butler matrix output ports to form a beam is that for the chosen antenna element spacing, the contributions from these unused outputs would have distorted the beam, as is explained below.

The outputs of the variable phase shifters 24 are connected by N equal length transmission lines 28 to a beam forming network 30 which, for example, may include a summing junction 32 comprising power combining elements such as resistively-isolated tees, for the formation of a single beam.

Butler matrices generally are passive and reciprocal microwave devices. A signal into any input port 10 of the Butler matrix generally results in signals of equal amplitude and a linear phase gradient at the output ports 12 of the matrix. The phase gradient is determined by which input port is excited. Exciting a single input port results in a specific far field radiation or mode pattern from the circular array antenna. The antenna pattern will have an essentially omnidirectional amplitude and a linearly varying phase gradient. Thus, the Butler matrix may be viewed as performing a standard mathematical transform of a linear array. A description of a typical Butler matrix, beam forming network and steering circuit (including phase shifters) is provided in U.S. Pat. Nos. 4,316,192 and 4,414,550, mentioned previously, which disclosures are incorporated herein by reference.

A derivation of the errors associated with a Butler matrix fed circular antenna array, which errors will result in beam distortion, is described below. For purposes of the description, it is assumed that the antenna array is acting as a receiving antenna; however, due to the reciprocal operability of the antenna, the following description holds true for an array used as a transmitting antenna. For the following description, resort should be had to the circular antenna array shown in FIG. 1 of the drawings, and the schematic representation of the same illustrated by FIG. 2.

Figure 2:
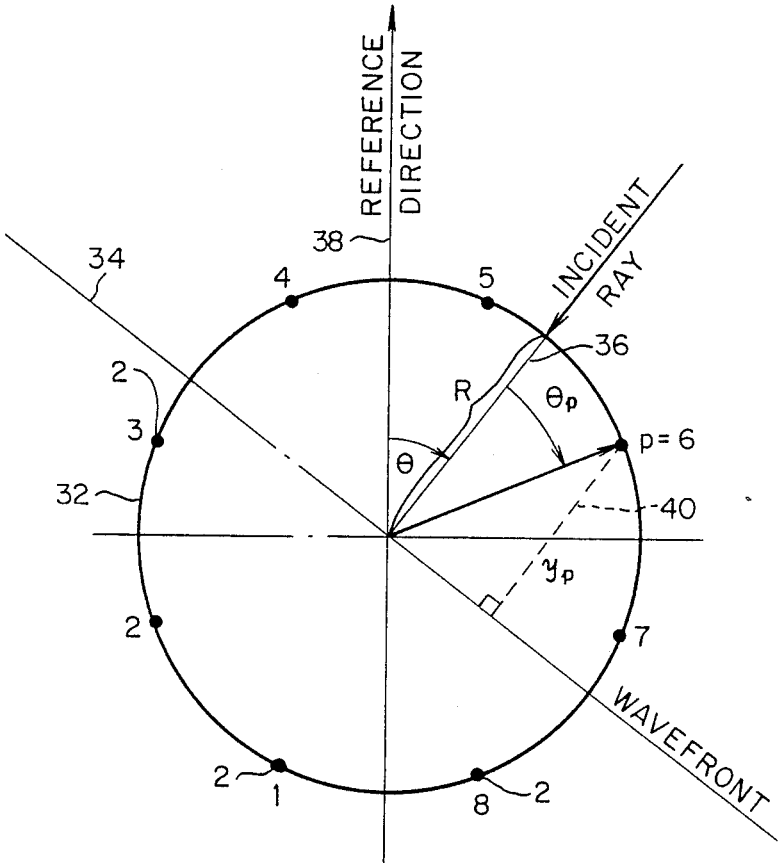
FIG. 2 is a schematic diagram illustrating the operation of the antenna array of FIG. 1.

FIG. 2, a schematic defining angles and directions, is useful in illustrating the operation of the arrangement shown in FIG. 1. For such illustrative purposes, assume initially that the N antenna elements 2 have omnidirectional radiation response patterns (which simplifies the explanation) and are arranged in a circle 32 of radius R. Assume further that a signal wavefront 34 at radian frequency $w_s$ (having a wavelength $\lambda_s$) is incident from the direction $\Theta$. This direction is defined as the angle between the incident ray 36 (a perpendicular to the wavefront) and a reference direction line 38 which is fixed relative to the set of elements 2. Each element 2 of the set is consecutively numbered, starting with the element on the left side of and closest to the rearward extension of the reference direction line 38 and proceeding in a clockwise direction. Thus, the element on the left side and closest to the rearward extension of line 38 is numbered 1, that on the right side and closest to the rearward extension of line 38 is numbered N, and a generally chosen element is numbered p. The angle that the incident-signal ray 36 makes with a radius extending through element p is given by $\Theta_p$ where:

$$\Theta_p=(p-\bar{n})2\pi/N-\Theta$$

and $$\bar{n}=(N+1)/2$$

The signals received by each element are advanced differentially relative to that which would have been received by an element at the center of the array (the phase and time reference point) by an amount proportional to the distance 40, whose magnitude is given by $y_p$ where:

$$y_p = R \cos \Theta_p$$

The signal received by the pth element, $e_p$, experiences a phase shift proportional to $y_p$. Thus $e_p$ can be expressed as:

$$e_p = \exp j(w_s t + 2\pi y_p/\lambda_s)$$

$$= \exp j(w_s t + r \cos \Theta_p)$$

where $r = 2\pi R/\lambda_s$, which is the circumference of the antenna in terms of wavelength, and t=time.

Referring once again to FIG. 1, the signals $e_p$ received by elements 2 are applied to RF Butler matrix 8. This Butler matrix divides the signal at its pth input into N equal parts, phase shifts each by an amount, $\phi_{pn}$, and combines each with signals which originated from other input ports to form the sum $e_n$ at its nth output. The phase shift $\phi_{pn}$ of the Butler matrix is dependent on both p and n and is given by:

$$\phi_{pn} = (p - \bar{n})(n - A)(2\pi/N)$$

where A=any number (or zero), and $\phi_{pn}$ is modulo $2\pi$. Thus, the output voltage, $e_n$, is the summation:

$$e_n = \frac{1}{\sqrt{N}} \sum_{p=1}^{p=N} \exp j[w_s t + \overbrace{r \cos \Theta p}^{C} + \overbrace{(p - n)(n - A)(2\pi/N)}^{C}]$$

where the $\sqrt{N}$ accounts for the N-way power division. The terms indicated by C represent the phase shift caused by the angle of incidence of the signal, and the terms indicated by B represent the additional phase contributed by the Butler matrix. It can be shown that the summation equates to the form:

$$e_n = \sqrt{N} \exp(j\, w_s t) \sum_{q=-\infty}^{\infty} J_u(r) \exp\left(-ju\left(\Theta - \frac{\pi}{2}\right)\right)$$

for $u = qN - (n - A)$ and $J_u(r)$ is the Bessel Function of order u and argument r.

In most practical applications, N will be at least 8, and more typically will be chosen as the binary number 16 or 32. Also, for convenience, A will usually be chosen as equal to N/2. Under these conditions, the summation can be approximated by the q=0 term so that $e_n$ can be approximated by:

$$e_n \approx \sqrt{N}\, J_{(N/2-n)}(r) \exp j[w_s t - (N/2 - n)(\Theta - \pi/2)]$$

Thus, with the above approximation, the outputs of RF Butler matrix 8, $e_n$, are signals with phase linearly dependent on $(N/2 - n)\Theta$.

It is of interest to compare this phase angle expression to that for the signal received by the nth element of a hypothetical, N-element linear array in which the phase reference is taken as the signal received by the element n=N/2. In this hypothetical case, the received signal has a phase which is $(N/2 - n)\beta$, where $\beta$ is given by $(2\pi d/\lambda_s) \cdot \sin \Theta'$, d is the inter-element spacing and $\Theta'$ is the angle that the incident signal ray makes with the normal to the array axis. This similarity of form for phase angle expression has led to the common practice in the prior art of calling the Butler matrix a circular array linearizer, and to the common practice of processing the outputs of the Butler matrix, $e_n$, as if they had come from the elements of a linear array. Indeed, the Butler matrix is a real-time discrete Fourier transformer and the process of obtaining outputs corresponding to Fourier spatial harmonics of the current distribution of the circular array has been called by the prior art, the process of linearizing the array.

This linear array equivalence is an approximation because of the approximation in equating the summation in the expression for $e_n$ to just its principal term. The approximation is excellent for most values of n; however, a second term (i.e., the principal residual term) specified by q=−1 or q=+1 is of comparable magnitude for n=1 and n=N, respectively. Nevertheless, in most practical applications, the signals $e_n$ for n near unity and n near N are intentionally attenuated relative to those for intermediate values of n (for suppression of response pattern sidelobes). Thus, the values of $e_n$ of greatest importance are those for intermediate values of n, which fortunately are those for which the approximation is most valid.

The principal term is a good approximation to $e_n$ when $d/\lambda$ (i.e., the spacing between antenna elements in terms of wavelength) is relatively small; however, the approximation will not hold true for $d/\lambda$ which is relatively large, as will be discussed in greater detail.

The expression presented for $e_n$ has been derived for the case where the N elements 2 have omnidirectional response patterns in order to more easily illustrate the manner of derivation. However, most practical element response patterns have a directional dependence relative to element orientation. Usually, to maintain circular symmetry, each element is oriented so that its peak response is directed radially outward. In this case, the signal received by each element when a plane wave is incident will generally differ in magnitude as well as phase from that received by the other elements. This requires a more complex analysis but leads to a form of solution which also can be treated as if it came from a linear array. To outline the form of the analysis, consider that any element pattern symmetrical about $\Theta_p = 0$ can be expressed as a summation of $\cos \tau\, \Theta_p$ terms (a Fourier series representation, where $\tau$ is an integer parameter which represents the harmonic number of terms in the summation), and that the $\cos \tau\, \Theta_p$ itself is the sum of two exponential terms, i.e.:

$$\cos \tau\, \Theta_p = \tfrac{1}{2}[\exp(j\, \tau\, \Theta_p) + \exp -(j\, \tau\, \Theta_p)]$$

Now, by an analysis similar to that already presented, it can be shown that for an exponential element angular response pattern, $\exp(j\, \tau\, \Theta_p)$, the signals $e_n$ output by the Butler matrix are given by the summation:

$$e_n = \sqrt{N} \exp j\left(w_s t - \tau \frac{\pi}{2} \sum_{q=-\infty}^{q=\infty} J_{u-\tau}(r) \exp(-ju(\Theta - \tau/2))\right.$$

$$\text{for } u = qN - (n - A).$$

For response patterns which are sums of such exponentials, the signals, $e_n$, output by RF Butler matrix 8 are obtained by linear superposition of the individual outputs from each of the exponential terms. For example, suppose that the angular response pattern of each element 2 is a cardioid, i.e., that it is given by the expression $(1+\cos\Theta_p)/2$. This response pattern can be represented by three terms: a constant and two exponentials. The outputs from RF Butler matrix 8 for this case are given by:

$$\begin{aligned} e_n &= \tfrac{1}{2}\sqrt{N}\exp(jw_st)\sum_{q=-\infty}^{\infty}[J_u(r)-\tfrac{1}{2}j(J_{u-1}(r)-J_{u+1}(r))]\exp\left(-ju\left(\Theta-\frac{\pi}{2}\right)\right) \\ &= \tfrac{1}{2}\sqrt{N}\exp(jw_st)\sum_{q=-\infty}^{\infty}[(1+ju/r)J_u(r)-jJ_{u-1}(r)]\exp\left[-ju\left(\Theta-\frac{\pi}{2}\right)\right] \end{aligned}$$

for $u = qN-(n-A)$.

Once again making the selection $A=N/2$ and $N\geqq 8$, $e_n$ can be approximated by principal terms, i.e., $$\begin{aligned} e_n &\approx \tfrac{1}{2}\sqrt{N}[(1+j(N/2-n)/r)J_{(N/2-n)}(r)-jJ_{(N/2-n-1)}(r)]\exp j\left[w_st-(N/2-n)\left(\Theta-\frac{\pi}{2}\right)\right] \\ &\approx \sqrt{N}K(N/2-n,r)\exp j\left[w_st-(N/2-n)\left(\Theta-\frac{\pi}{2}\right)\right] \end{aligned}$$

where K is a complex quantity dependent on $(N/2-n)$ and on r, but independent of $\Theta$. Note that if the phase offsets represented by the arguments of K are removed by use of appropriate delay lines or phase shifts (called focusing, the function provided by the fixed phase shifters 16), then the resulting signals, $e_n'$, have phase angles which are linearly dependent on $(N/2-n)\Theta$, just as in the first case discussed (where the elements were omnidirectional). Note, too, that the amplitude weighting represented by the magnitude K can be readjusted by the set of differential amplitude weights 18 (differential attenuators or amplifiers) to provide a low sidelobe response pattern, or readjusted to provide uniform values of $e_n$ (no weighting) for achieving maximum gain.

It will now be shown that the linear approximation of the circular array provided by the Butler matrix does not hold true if the spacing between antenna elements is relatively large.

It has been shown previously that the outputs of the Butler matrix for the cardioid pattern may be expressed as follows:

$$e_n = \tfrac{1}{2}\sqrt{N}\exp(jw_st)\sum_{q=-\infty}^{\infty}[J_u(r)-\tfrac{1}{2}j(J_{u-1}(r)-J_{u+1}(r))]\exp(-ju(\Theta-\pi/2))$$

for $u = qN-(n-A)$ or, dropping the time dependent exponential for simplicity, substituting $A=N/2$, and collecting terms, $e_n$ can be expressed explicitly as a summation of $\Theta$ dependent phase terms weighted by complex coefficients. That is:

$$e_n = \sqrt{N}\sum_{q=-\infty}^{\infty}K_q\exp(-ju\Theta)$$

where $$K_q=\tfrac{1}{2}[J_u(r)-\tfrac{1}{2}j(J_{u-1}(r)-J_{u+1}(r))]\exp ju(\pi/2)$$

$K_q$ represents the complex coefficients which weight the terms in the expansion for $e_n$, the Butler matrix outputs. For the case where $q=0$, $K_o$ represents the coefficient of the principal term of the expansion. For the case where $q=\pm 1$, $K_{+1}$ and $K_{-1}$ represent the coefficients of the principal residual terms of the expansion.

When the spacing between antenna elements is small, the principal term coefficient, $K_o$, predominates over those of the residual terms, including the principal residual terms, $K_{+1}$ and $K_{-1}$, which are the largest of the residual terms, and the residual terms may be neglected. In such a situation, the Butler matrix will accurately linearize the circular array (in the sense described earlier).

However, it is the residual terms, including those associated with $K_{+1}$ and $K_{-1}$, which cause beam distortion. When the residual terms become significant relative to the principal term associated with $K_o$, the Butler matrix no longer provides an accurate linearization of the circular array. This situation occurs when the spacing between antenna elements is relatively large in terms of wavelength.

The principal term of the Butler matrix output $e_n$ for the cardioid element pattern case is given by the $q=0$ case, i.e., $$e_n=\sqrt{N}K_o\exp -j[(N/2-n)\Theta]$$

where

N=total number of elements in the circular array, $\Theta$=azimuth direction, and n=Butler matrix output port (numbered 1 through N), and where $$K_o=\tfrac{1}{2}[J(N/2-n)(r)-\tfrac{1}{2}j(J_{(N/2-n-1)}(r)-J_{(N/2-n+1)}(r))]\exp j(N/2-n)\pi/2$$

where $r=2\pi R/\lambda$, which is the array circumference in wavelengths and which also equals the radius R of the array in radians of phase.

Table 1 below shows the calculation of the principal term $K_o$ (i.e., $K_q$ where $q=0$) for the case of a circular array having 16 antenna elements ($N=16$) and a circumferential spacing between elements of $\lambda/2$ (i.e., $r=N/2=8$). For this example, $K_o$ is given by:

$$K_o = \tfrac{1}{2}[J_{8-n}(8)-\tfrac{1}{2}j(J_{7-n}(8)-J_{9-n}(8))]\exp j(8-n)\frac{\pi}{2}$$

TABLE 1

| n | $J_{8-n}(8)$ | $J_{7-n}(8)$ | $J_{9-n}(8)$ | $K_o$ |
|---|---|---|---|---|
| 1 | +0.320589 | +0.3375759 | +0.2234550 | 0.162814/−100.1° |
| 2 | +0.3375759 | +0.1857747 | +0.3205890 | 0.17212/−168.7° |
| 3 | +0.1857747 | −0.1053574 | +0.3375759 | 0.144533/+140.0° |
| 4 | −0.1053574 | −0.2911322 | +0.1857747 | 0.13035/+113.8° |
| 5 | −0.2911322 | −0.1129917 | −0.1053574 | 0.14558/+89.25° |
| 6 | −0.1129917 | +0.2346363 | −0.2911322 | 0.14307/+66.8° |
| 7 | +0.2346363 | +0.1716508 | −0.1129917 | 0.13721/−58.8° |

TABLE 1-continued

| n | $J_{8-n}(8)$ | $J_{7-n}(8)$ | $J_{9-n}(8)$ | $K_o$ |
|---|---|---|---|---|
| 8 | +0.1716508 | −0.2346363 | +0.2346363 | 0.14536/−53.8° |
| 9 | −0.2346363 | −0.1129917 | +0.1716508 | 0.13721/−58.8° |
| 10 | −0.1129917 | +0.2911322 | −0.2346363 | 0.14307/+66.7° |
| 11 | +0.2911322 | −0.1053574 | −0.1129917 | 0.14558/+89.25° |
| 12 | −0.1053574 | −0.1857747 | +0.2911322 | 0.13035/+113.8° |
| 13 | −0.1857747 | +.3375759 | −0.1053574 | 0.144533/+140.0° |
| 14 | +0.3375759 | −.3205890 | −0.1857747 | 0.17212/−168.7° |
| 15 | −0.3205890 | +0.2234550 | +.3375759 | 0.16281/−100.1° |
| 16 | +0.2234550 | −0.12632 | −0.320589 | 0.12183/+23.5° |

$e_n$ is now further examined to determine what effect the residual terms have on the Butler matrix linearization of the circular array. The derivation for the principal residual terms $K_{-1}$ and $K_{+1}$ from the equation described previously for the case where $q=-1$ or $q=+1$ is shown below.

For $q=-1$, $u=-N/2-n$ and for $q=+1$, $u=3N/2-n$, since $u=qN-(n-N/2)$. As stated previously, $$K_q=\tfrac{1}{4}[J_u(r)-\tfrac{1}{4}j(J_{u-1}(r)-Ju+1(r))]\exp ju(\pi/2)$$

Thus, for N=16 (i.e., there are 16 antenna elements) and λ/2 spacing between antenna elements, i.e., r=8, as in the example described previously, $$u|_{q=1}=(-8-n), \text{ and } u|_{q=+1}=(24-n)$$

Therefore, $$K_{-1}=\tfrac{1}{4}[J_{-8-n}(8)-\tfrac{1}{4}j(J_{-9-n}(8)-J_{-7-n}(8))]\exp j(-8-n)\pi/2,$$

and $$K_{+1}=\tfrac{1}{4}[J_{24-n}(8)-(J_{23-n}(8)-J_{25-n}(8))]\exp j(24-n)\pi/2$$

Table 2 below shows the calculations for the principal residual term $K_{-1}$.

TABLE 2

| n | $J_{-8-n}(8)$ | $J_{-9-n}(8)$ | $J_{-7-n}(8)$ | $K_{-1}$ |
|---|---|---|---|---|
| 1 | −0.1263209 | +0.0607670 | +0.2234550 | 0.07512/+57.2° |
| 2 | +0.0607670 | −0.0255967 | −0.1263209 | 0.03946/+140.3° |
| 3 | −0.0255967 | +0.0096238 | +0.0607670 | 0.01809/−135.0° |
| 4 | +0.0096238 | −0.0032748 | −0.0255967 | 0.00737/−49.2° |
| 5 | −0.0032748 | +0.0010193 | +0.0096238 | 0.00270/+37.3° |
| 6 | +0.0010193 | −0.0002926 | −0.0032748 | 0.00090/+124.4° |
| 7 | −0.0002926 | +0.00007801 | +0.0010193 | negligible term |
| 8 | +0.00007801 | −0.00001942 | −0.0002926 | negligible term |

Table 3 below shows the calculation for the principal residual term $K_{+1}$.

TABLE 3

| n | $J_{24-n}(8)$ | $J_{23-n}(8)$ | $J_{25-n}(8)$ | $K_{+1}$ |
|---|---|---|---|---|
| 8 | +0.0000780 | 0.00001942 | 0.0002926 | negligible term |
| 9 | +0.0002926 | 0.00007801 | 0.0010193 | negligible term |
| 10 | +0.0010193 | 0.0032748 | 0.0002926 | 0.00090/+124.4° |
| 11 | +0.0032748 | 0.0096238 | 0.0010193 | 0.00270/+37.28° |
| 12 | +0.0096288 | 0.0255967 | 0.0032748 | 0.00737/−49.2° |
| 13 | +0.0255967 | 0.0607670 | 0.0096238 | 0.01809/−135.0° |
| 14 | +0.0607670 | 0.1263209 | 0.0255967 | 0.03946/+140.3° |
| 15 | +0.1263209 | 0.2234550 | 0.0607670 | 0.07512/+57.2° |
| 16 | +0.2234550 | 0.3205891 | 0.1263209 | 0.12183/−23.5° |

The $K_{-1}$ values for n=9 through 16 are negligible, and are therefore not recorded in Table 2. The same holds true for the $K_{+1}$ values for n=1 through 7 and thus these values are not recorded in Table 3.

It should be noted that $J_{24}(8)=+2\times10^{-10}$ so that the q=+2 case is of no concern. The q=−2 case is also of no concern for the same reason. More specifically, for the 16th output port of the Butler matrix (i.e., n=16), the secondary residual terms specified by q=+2 through ∞ and q=−2 through −∞ are so small relative to the coefficients of the principal residual terms that they may be neglected for purposes of this analysis.

It can be seen from Tables 2 and 3 that the principal residual term coefficients $K_{-1}$ and $K_{+1}$ are greatest at the first and sixteenth output ports (i.e., n=1 and 16) of the Butler matrix. Thus, it is of interest to examine the effect of residual terms on $e_n$ for the first and for the sixteenth port (i.e., n=16). $e_{16}$ is essentially the sum of the principal term (with coefficient, $K_o$) and the principal residual term (coefficient $K_{+1}$), that is, $$\begin{aligned} e_{16} &= [4(0.122\exp + j23.5°)\exp + j8\Theta] + \\ &\quad 4(0.122\exp - j23.5°)\exp - j8\Theta] \\ &= .488\,[\exp + j(23.5° + 8\Theta) + \exp - j(23.5 + 8\Theta)] \end{aligned}$$

In this case, the term associated with $K_1$ is of equal magnitude to that associated with $K_o$ and is counter-rotating in phase. The combination of both terms becomes a simple cosinusoid:

$$e_{16}=0.968\cos(8\Theta+23.5°)$$

The combination has lost the desirable phase rotation with Θ (expj8Θ) and constant amplitude exhibited by the term associated with $K_o$, and instead exhibits no phase rotation and an undesirable amplitude rotation. The voltage $e_{16}$ does not act like it came from an element of a linear array, and thus when summed with the voltages from the other Butler matrix outputs, $e_{16}$ will contribute to beam distortion.

Similarly, for the first port of the Butler matrix (i.e., n=1), $$\begin{aligned} e_1 &= [4(0.163\exp - j100.1°)\exp(-j7\Theta)] + \\ &\quad [4(.075\exp + j(57.2°)\exp + j9\Theta] \\ &= \underbrace{.352\exp j(-7\Theta - 100.1°)}_{A} + \\ &\quad \underbrace{0.600[\exp j(\Theta - 21.5°)]\cos(78.7° + 8\Theta)}_{B} \end{aligned}$$

which includes a term with the desirable phase rotation (−7Θ) and constant amplitude (i.e., term A), and a term which varies in amplitude with cos 8Θ and in phase with Θ (i.e., term B), which is an undesired term.

The output of each of the other 14 ports of the Butler matrix contains an increasing proportion of the term with the desirable phase rotation as the port number approaches 8, because the principal residual terms decrease in relative magnitude as n approaches N/2.

The example presented above is for the case of half-wavelength antenna element spacing. A convenient way to illustrate quality of the linear array approximation with variations of the spacing parameter is to compare the magnitude of the $K_{+1}$, n=N principal residual term (worst case) with the magnitude of the $K_o$, n=N/2 principal term by the following ratio:

$$\text{Ratio} = \left| \frac{J_{N/2}(r) - \frac{1}{2}(J_{N/2-1}(r) - J_{N/2+1}(r))}{J_o(r) - \frac{1}{2}(J_{-1}(r) - J_{+1}(r))} \right|$$

$$\text{where } r = \frac{\text{spacing}}{\lambda} \cdot N$$

The ratio provided above assumes the case where no amplitude tapering of the outputs $e_n$ has occurred (and the use of a cardioid element pattern). The numerator of the ratio shown above represents the principal residual term (this term causes beam distortion), and the denominator represents the principal term relied on in a Butler matrix circular array linearization approximation (this term should be relied on solely when the antenna element spacing is relatively small).

Table 4 below shows how the principal residual terms (i.e., the numerator of the above ratio) will dominate the principal terms (i.e., the denominator) as the spacing between antenna elements increases, for the case where N=16 elements:

TABLE 4

| Spacing X | r | $J_o(r)$ | $J_{-1}(r)$ | $J_{+1}(r)$ | $J_8(r)$ | $J_7(r)$ | $J_9(r)$ | Ratio |
|---|---|---|---|---|---|---|---|---|
| 0.625 | 10 | −0.24593 | +.043473 | +.043473 | +.317854 | 0.216711 | 0.291856 | 1.282/−176.7 |
| 0.5 | 8 | +0.171651 | −0.234636 | +.234636 | +.223455 | 0.320589 | 0.126821 | 0.838/−77.3 |
| 0.375 | 6 | +0.150645 | +0.276683 | −0.276683 | +.056532 | 0.129587 | +.0211653 | 0.249/+17.4 |
| 0.25 | 4 | +.3971498 | +.066043 | −.066043 | +.004028 | +.015176 | +.000939 | 0.020 /−51.0° |
| 0.125 | 2 | +.22389 | −0.57672 | +.57672 | +.000022 | +.00017 | +.000002 | ~0 |

It can be seen from the above table that the residual terms are only significant for spacings above 0.375λ (that is, they are 10 dB lower at 0.375λ than at 0.5λ spacing). The residual terms cause beam distortion. For operating frequencies where the spacing between antenna elements 2 on circular arrays is in excess of 0.375 wavelengths, beam distortion increases rapidly with an increase in the spacing. Beam distortion starts to become significant at a spacing of about 0.4λ. At about 0.5λ, beam distortion is prominent but for most applications still tolerable. At about 0.6λ spacing, the beam would be highly distorted if all the Butler matrix outputs are used in its formation. Applications which require such large spacings have had to waste the energy received at the outermost Butler matrix outputs and form beams only from the inner core of outputs (n close to N/2).

Accordingly, a circular array should be constructed with its antenna elements 2 spaced apart a fixed distance in terms of λ, that is, preferably between about 0.3λ and about 0.4λ, and optimally at about 0.35λ or 0.375λ. 0.3 is chosen as the lower limit for the spacing in order to minimize any mutual coupling between elements.

For these reasons, conventional Butler matrix fed circular arrays producing electronically steerable directional beams have limited bandwidth, and that the preferred spacing between antenna elements should be between about 0.3 wavelengths and 0.4 wavelengths.

Figure 3:
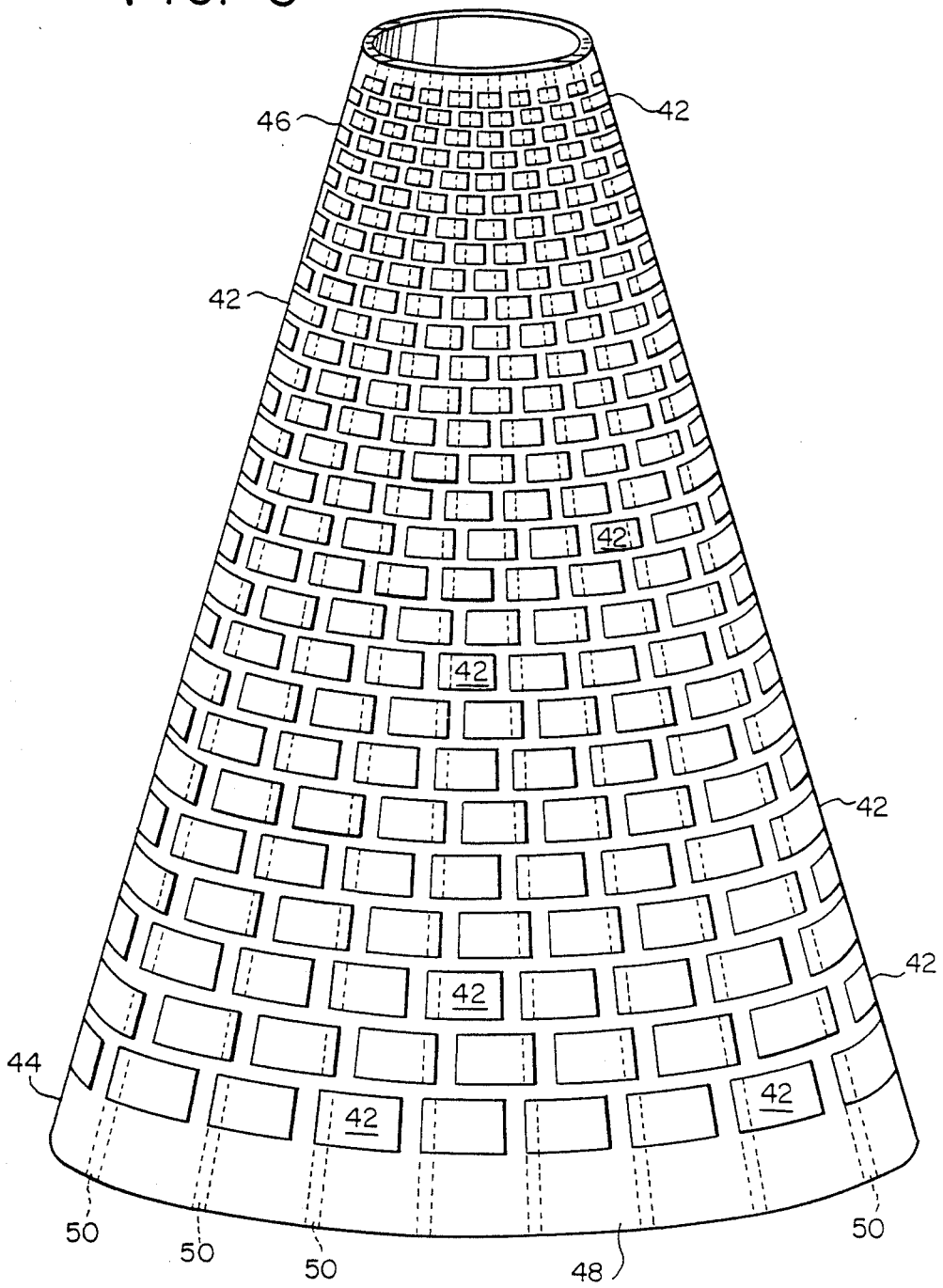
FIG. 3 is a perspective view of a circular array antenna formed in accordance with one form of the present invention.

FIG. 3 illustrates a preferred form of an antenna array constructed in accordance with the present invention. The circular array includes a plurality of antenna elements 42. The elements are spaced apart from each other and situated in a conical arrangement and in parallel rows of varying diameters circumferentially about the longitudinal axis of the conical arrangement.

Each antenna element 42 has a phase center. The circumferential spacing between the phase centers of adjacent antenna elements of any one row situated closer to the base or wider portion 44 of the conical arrangement is greater than that of adjacent antenna elements situated relatively closer to the apex or narrower portion 46 of the conical arrangement. Stated another way, the circumferential spacing between the phase centers of adjacent antenna elements of any one row of a given diameter is greater than that of adjacent antenna elements 42 of any other row having a smaller diameter.

Also, the respective operating (i.e., resonating) frequencies of the antenna elements 42 of any one row situated closer to the base of the conical arrangement is lower than the operating frequencies of the antenna elements 42 of any other row situated relatively closer to the apex of the conical arrangement. Again stated another way, the respective operating frequencies of the antenna elements 42 of any one row of a given diameter are lower than the operating frequencies of the antenna elements of any other row having a smaller diameter.

In a preferred form of the invention, a conically-shaped support 48 defining an insulation-sheathed conductive ground plane may be used, and the plurality of antenna elements 42 are mounted on the support in parallel rows circumferentially about the longitudinal axis of the support 48.

The circular array further includes a plurality of feed lines 50. Each feed line 50 couples to an antenna element 42 of each row in progression. Preferably, the feed lines extend substantially in the general direction of the longitudinal axis of the conical arrangement.

The antenna elements 42 may be in the form of dipoles, monopoles, slots or other types of radiating or receiving elements. In the preferred form, however, the antenna elements 42 are microstrip patches, the microstrip patches being electromagnetically coupled to respective feed lines 50.

The particular shape of the circular array antenna and the arrangement of antenna elements 42 provide a circumferential spacing between the phase centers of adjacent antenna elements that is constant and maintained at a fixed value of the wavelength of the operating frequency of the antenna elements. The circumferential spacing between the phase centers of adjacent antenna elements 42 is preferably between about 0.3λ and about 0.4λ, where λ equals the wavelength of the frequency at which the antenna elements operate. Optimally, the circumferential spacing between the phase centers of adjacent antenna elements is set at about 0.35λ.

With the configuration of the present invention described above, the circular array has a wider bandwidth than conventional circular arrays. At higher frequencies, the patches or antenna elements more towards the apex or narrower portion 46 of the conical arrangement will be operational, in accordance with well known log periodic array techniques, and the spacing between the phase centers is maintained between about 0.3λ and about 0.4λ. At lower frequencies, the antenna elements more towards the base or wider portion 44 of the conical arrangement become operational. The spacing between the phase centers of these antenna elements is also held constant and to be within the preferred range of about 0.3λ to about 0.4λ. Accordingly, at no matter what signal frequency the circular array of the present invention is transmitting or receiving, the effective spacing between the phase centers is held to a constant value or range of values of the wavelength of the transmitted or received signal, which value will not cause beam distortion or excessive mutual coupling that results in impedance mismatch, thus overcoming the shortcomings of conventional circular arrays.

The circular array of the present invention is simple in construction and yet provides wideband operation. As with conventional circular arrays, the feed lines 50 may be connected to the appropriate input ports of a Butler matrix 8, the outputs of which may be further coupled to a plurality of first phase shifters 16, amplitude weighting devices 18, variable second phase shifters 24 for beam steering, a beam forming network 30 and a steering circuit 26, all of the above being interconnected in the manner illustrated by FIG. 1, so that the array will produce an electronically steerable directional beam.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A circular array antenna, which comprises:

a plurality of antenna elements, the antenna elements being spaced apart from each other and situated in a conical arrangement and in parallel rows of varying diameters circumferentially about the longitudinal axis of the conical arrangement, each antenna element having a phase center, the circumferential spacing between the phase centers of adjacent antenna elements of any one row of a given diameter being greater than that of adjacent antenna elements of any other row having a smaller diameter, the respective operating frequencies of the antenna elements of any one row of a given diameter being lower than the operating frequencies of the antenna elements of any other row having a smaller diameter; and a plurality of feed lines, at least one antenna element of each row being coupled to a respective feed line;

wherein the circumferential spacing between the phase centers of adjacent antenna elements of the conical arrangement of elements is maintained at a fixed value of the wavelength of the operating frequencies of the antenna elements.

2. A circular array antenna as defined by claim 1, wherein the circumferential spacing between the phase centers of adjacent antenna elements is between about 0.3λ and about 0.4λ, where λ equals the wavelength of the operating frequency of the antenna elements.

3. A circular array antenna as defined by claim 1, wherein the circumferential spacing between the phase centers of adjacent antenna elements is about 0.35λ, where λ equals the wavelength of the operating frequency of the antenna elements.

4. A circular array antenna as defined by claim 1, wherein the plurality of feed lines extend substantially in the direction of the longitudinal axis of the conical arrangement.

5. A circular array antenna as defined by claim 1, wherein the antenna elements are microstrip patches which are electromagnetically coupled to respective feed lines.

6. A circular array antenna, which comprises:

a conically shaped support, the support defining an insulation-sheathed conductive ground plane;

a plurality of antenna elements, the antenna elements being mounted on the support in parallel rows of varying diameters circumferentially about the longitudinal axis of the support and being spaced apart from each other, each antenna element having a phase center, the circumferential spacing between the phase centers of adjacent antenna elements of any one row of a given diameter being greater than that of adjacent antenna elements of any other row having a smaller diameter, the respective operating frequencies of the antenna elements of any one row of a given diameter being lower than the operating frequencies of the antenna elements of any other row having a smaller diameter; and a plurality of feed lines mounted on the support, each feed line being coupled to an antenna element of each row in progression;

circumferential spacing between the phase centers of adjacent antenna elements is maintained at a fixed value of the wavelength of the operating frequencies of the antenna elements.

7. A circular array antenna as defined by claim 6, wherein the antenna elements are microstrip patches, the microstrip patches being electromagnetically coupled to respective feed lines; and wherein the circumferential spacing between the phase centers of adjacent antenna elements is between about 0.3λ and about 0.4λ, where λ equals the wavelength of the operating frequency of the antenna elements.

* * * * *